US005358444A

United States Patent [19]

Helm et al.

[11] Patent Number: 5,358,444

[45] Date of Patent: Oct. 25, 1994

[54] WORKSTATION VENTILATION SYSTEM

[75] Inventors: Randall S. Helm, Kentwood, Mich.; James R. Ahart, St. Louis, Mo.

[73] Assignee: Steelcase Inc., Grand Rapids, Mich.

[21] Appl. No.: 54,079

[22] Filed: Apr. 27, 1993

[51] Int. Cl.[5] ..... F24F 13/02

[52] U.S. Cl. ..... 454/306

[58] Field of Search ..... 454/230, 306, 313, 319, 454/320

[56] References Cited

U.S. PATENT DOCUMENTS

| | | | |
|---|---|---|---|
| 2,882,835 | 4/1959 | Buchanan | 105/314 |
| 3,049,067 | 8/1962 | Claude . | |
| 3,533,200 | 10/1970 | Zoebelein | 52/35 |
| 3,789,747 | 2/1974 | Wasserman et al. . | |
| 3,835,758 | 9/1974 | Bean . | |
| 3,920,299 | 11/1975 | Propst et al. | 312/223 |
| 3,956,977 | 5/1976 | Turko et al. . | |
| 4,002,109 | 1/1977 | Hori et al. . | |
| 4,072,187 | 2/1978 | Lodge | 165/48 |
| 4,094,256 | 6/1978 | Holper et al. | 108/50 |
| 4,250,800 | 2/1981 | Brockmeyer | 454/306 |
| 4,286,419 | 9/1981 | Treffers | 52/39 |
| 4,351,475 | 9/1982 | Hudson | 237/46 |
| 4,370,155 | 1/1983 | Armbruster . | |
| 4,378,727 | 4/1983 | Doss . | |
| 4,399,739 | 8/1983 | Dean . | |
| 4,409,889 | 10/1983 | Burleson . | |
| 4,506,595 | 3/1985 | Roberts et al. . | |
| 4,535,577 | 8/1985 | Tenser et al. | 52/221 |
| 4,625,633 | 12/1986 | Martin . | |
| 4,784,445 | 11/1988 | Ott | 312/236 |
| 4,872,397 | 10/1989 | Demeter et al. . | |
| 4,942,805 | 7/1990 | Hellwig et al. . | |
| 4,950,871 | 8/1990 | Pollak et al. . | |
| 4,974,915 | 12/1990 | Bussard | 454/230 X |
| 5,065,668 | 11/1991 | Mitchell et al. . | |
| 5,065,832 | 11/1991 | Mark | 454/230 |
| 5,074,116 | 12/1991 | Kadotani et al. | 62/3.2 |
| 5,135,436 | 8/1992 | Levy et al. | 454/306 |

FOREIGN PATENT DOCUMENTS

| | | | |
|---|---|---|---|
| 518391 | 2/1955 | Belgium | 454/306 |
| 1077767 | 5/1980 | Canada | 454/306 |
| 3149832 | 6/1983 | Fed. Rep. of Germany | 454/306 |
| 83541 | 4/1988 | Japan . | |
| 204050 | 8/1988 | Japan | 454/230 |

OTHER PUBLICATIONS

"A Totally Integrated Work Station at the Control of the Occupant", James W. Hudson *BC&M Yearbook* magazine, 1984–85, vol. II, p. 15.

"Displacement Ventilation–High–Tech, High–$$ Solution", *Indoor Air Quality Update,* Jun. 1991, pp. 11–15.

"Personalized Air System (PAS)", Structural Concepts Corp., date unknown.

"System Technodrant", H. Krantz GmbH & Co., date unknown.

Untitled product brochure, Pulse Inc., Allentown, Pa., James L. Harter, Sr., date unknown.

"Trianon", Center Core Inc., South Plainfield, N.J., date unknown.

"Airflow Plus", Center Core Inc., South Plainfield, N.J., date unknown.

"TAB Humanetics Group Clustered Workcenter", TAB Prod. Co., CA, date unknown.

(List continued on next page.)

*Primary Examiner*—Harold Joyce

*Attorney, Agent, or Firm*—Price, Heneveld, Cooper, DeWitt & Litton

[57] ABSTRACT

A workstation ventilation system is provided for offices divided into workstations by modular furniture units, such as partition panels, or the like. The ventilation system includes air ducts attached to the modular furniture units in the configuration of the furniture units, and further includes a collection and distribution unit for receiving air from an overhead ventilation system and for communicating the air through the air ducts to individual workstations. Optimally, the air ducts can be retrofittably attached to the furniture units to facilitate installation. Also optimally, the air ducts include air diffusers at each workstation, which air diffuers include individually adjustable deflectors to direct the conditioned air from the air ducts into the workstation area as desired.

24 Claims, 6 Drawing Sheets

OTHER PUBLICATIONS

"Klimadrant", H. Krantz GmbH & Co., date unknown.

"To Improve Office Design–Blow It Up", Hams F. Levy, Argon Corp., & Eric van Merkensteijn, Assoc. Dean, Univ. of PA, Oct. 30, 1987.

"Implications of User–Based Environmental Control Systems: Three Case Studies", P. Drake, P. Mill & M. Demeter, pp. 394–400.

"Strategies for Health Promotion through User–Based Environmental Control: A Select International Pespective", P. Drake et al., pp. 14–21 date unknown.

"Klimadrant", Klima+Kalte GmbH, date unknown.

"Boden–und Tischluftauslasse fur Buroraumklimatisierung System Technodrant", H. Krantz GmbH & Company, date unknown.

"Task Air Personal Comfort System", Tate Access Floors, Inc., Sep. 1986.

"Personal Environments Design Guide", Johnson Controls of Milwaukee, Wisc., Apr. 1989.

"Personal Environments", Johnson Controls, Milwaukee, Wisc., 1989.

"Climadesk", Mikroklimat Sweden AB, date unknown.

"Personalized Air System (PAS)", Structural Concepts Corp., Spring Lake, Mich., date unknown.

WORKSTATION VENTILATION SYSTEM

FIELD OF THE INVENTION

The present invention relates generally to ventilation systems, and in particular to a ventilation system adapted for use in an office with modular furniture units, such as partition panels or the like, dividing the office into workstations.

BACKGROUND OF THE INVENTION

Many modern offices are subdivided into workstations by modular furniture units, such as partition panels, freestanding furniture modules, etc. so that workers have the necessary privacy to do work efficiently and productively. However, ventilation of these workstations can be a problem since the partition panels may reduce air flow by blocking air flow. Traditional overhead ventilation systems do not include a sufficient number of air drops to adequately overcome this problem. Further, overhead ventilation systems do not allow adequate control at individual workstations. Still further, most partition panel systems are easily rearrangeable, thus potentially rendering any permanent ventilation system that was originally acceptable at least partially inadequate due to a rearrangement. Another problem is that overhead ductwork can be unsightly unless it is covered by a drop ceiling or the like. Those overhead ventilation systems not aesthetically covered by a drop ceiling are exposed and can detract considerably from the aesthetics of partition panel layouts. However, those overhead ventilation systems covered by a drop ceiling are quite difficult to rearrange, and can be expensive and also very disruptive to normal office work if rearrangement is required.

Some workstations have been constructed with ventilation systems incorporated therein. However, several of these known ventilation systems tend to dictate the layout of the partition panels (e.g. requiring the workstations to be in a hub arrangement) rather than being sufficiently flexible to allow the partition panels to be arranged in an optimal plan configuration. Further, many of these workstation ventilation systems require that new partition panels and/or furniture be purchased, which is expensive and requires considerable capital expenditure. Still other known ventilation systems lack aesthetics, and do not blend well with existing office decors. Another problem is that many of the known ventilation systems are not designed to cooperate with existing permanent building ventilation systems, but rather operate as independent and duplicate systems. This can be expensive, and typically is quite energy inefficient. Yet another problem is that most known personal ventilation systems are not retrofittable onto existing partition panel systems without considerable capital expenditure and work disruption during installation.

Thus, a ventilation system solving the aforementioned problems is desired.

SUMMARY OF THE INVENTION

In one aspect of the invention, a personal ventilation system is provided for a modular furniture system that includes a plurality of modular furniture units interconnected in a preselected plan configuration to form multiple workstations. The personal ventilation system includes an air supply adapted to pressurize and flow ventilation air therethrough. An air duct having a closed construction is shaped to communicate ventilation air therethrough, and is arranged in a plan configuration similar to the preselected plan configuration of the modular furniture units with the air duct extending along at least some of the modular furniture units to predetermine locations adjacent each of the workstations. The air duct is operably connected with the air supply to provide the pressurized ventilation air at each of the workstations. The personal ventilation system also includes a plurality of air diffusers communicating with the air duct and located at preselected locations adjacent each of the workstations.

In another aspect, a ventilation system is provided for furniture units arranged in a predetermined furniture landscape within a building room to define multiple workstations. Overhead duct work is located in the ceiling of the building room through which ventilation air is distributed from a building source into the building room. The ventilation system includes an outlet unit positioned in the ceiling of the building room and communicating with the overhead duct work. The outlet unit includes an outlet orifice shaped to focus ventilation air passing therethrough into a generally vertically oriented substantially columnar stream. The ventilation system further includes a collector and distributor unit associated with the furniture units, the collector and distributor unit being positioned a spaced apart distance below the ceiling. The collector and distributor unit includes an inlet orifice positioned generally directly below the outlet orifice and shaped to collect and funnel ventilation air in the columnar stream. The collector and distributor unit also includes means for distributing ventilation air flowing through the inlet orifice to the workstations and means for flowing ventilation air through the collector and distributor unit.

An object of the present invention is to provide a retrofittable ventilation system that can be arranged in a pattern corresponding to existing partition panels.

Another object of the present invention is to provide a clean overhead appearance while still utilizing the existing building ventilation system.

Another object of the present invention is to allow for individualized control over ventilation to each workstation at the workstation.

These and other features, advantages, and objects of the present invention will be further understood and appreciated by those skilled in the art by reference to the attached specification, claims and appended drawings.

BRIEF DESCRIPTION OF THE DRAWINGS

FIG. 7A is an enlarged view of the circled area labeled VIIA in FIG. 7;

DETAILED DESCRIPTION OF THE PREFERRED EMBODIMENT

Figure 1:
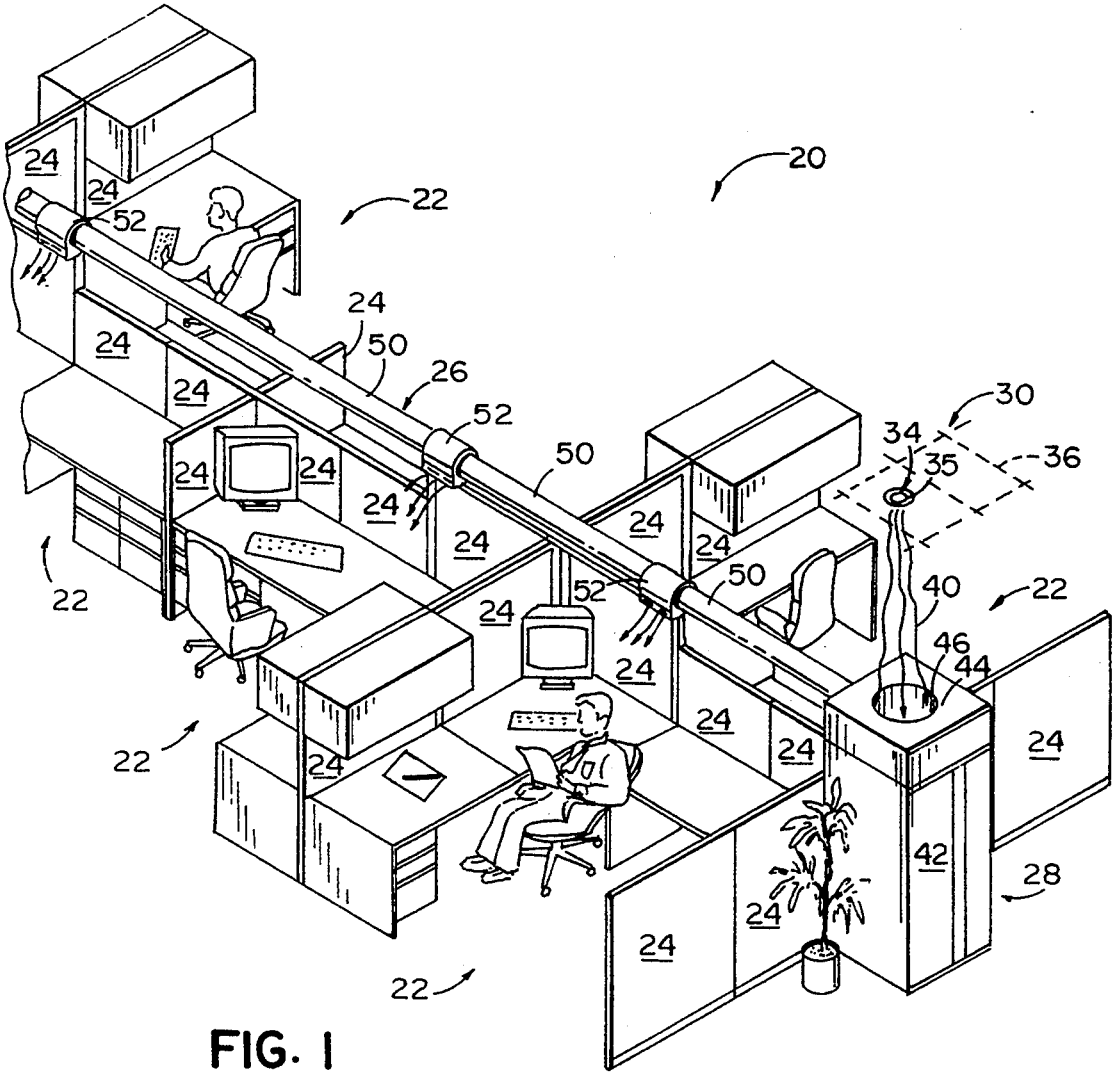
FIG. 1 is a perspective view of a workstation ventilation system embodying the present invention, the system being shown as installed in an office divided into workstations by modular furniture units including partition panels.

A workstation ventilation system 20 (FIG. 1) embodying the present invention is provided for offices divided into workstations 22 by modular furniture units such as the illustrated units which include partition panels 24 and other dividers. The ventilation system 20 includes air ducts 26 that are connected to the top of the partition panels 24 in the plan configuration of the partition panels. The ventilation system 20 further includes a collector and distributor unit 28 adapted to receive air such as from an overhead ceiling ventilation system 30. The collector and distributor unit 28 is connected to the air ducts 26 to communicate air received from overhead ventilation system 30 through air ducts 26 to the workstations 22. Advantageously, the illustrated preferred embodiment ventilation system 20 is adapted for retrofit installation on existing partition panels without the need for rearrangement of the partition panels, and without the need for considerable disruption of normal office work during installation. Further, the ventilation system is aesthetically pleasing, and is readily adaptable to a variety of different work environments. Further, the ventilation system 20 permits viewing and conversation above partition panels 24 and either above or below the ducts of the ventilation system.

Figure 2:
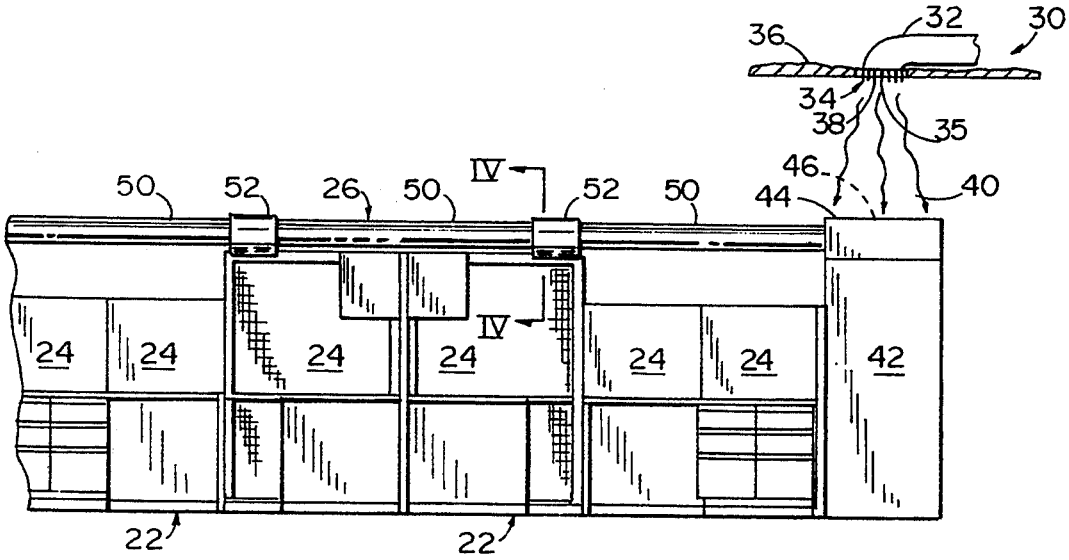
FIG. 2 is an elevational view of the ventilation system and office setting shown in FIG. 1.

Overhead ceiling ventilation system 30 (FIG. 1) includes an air supply/distribution ceiling duct 32 connected to a ceiling air vent 34 located in ceiling 36. Conditioned air is communicated through ceiling duct 32 from a central building conditioning unit (not shown) to vent 34. The illustrated ceiling air vent 34 (FIG. 2) includes an outlet orifice 35 with fins 38 for directing a columnar stream of condition air 40 exiting from ceiling duct 32 vertically downwardly into the building room. Columnar stream of air 40 is directed so that it flows generally vertically downwardly toward collector and distributor unit 28. Air column 40 in effect defines an "invisible duct" that allows conditioned air to be directed to the workstation air distribution system without the need for unsightly overhead air ducts extending from the ceiling down to the partition panels therebelow.

Collector and distributor unit 28 (FIG. 2) includes a cabinet 42 adapted to blend with the partition panels 24 and the general office decor. The upper surface 44 of cabinet 42 includes an inlet orifice or opening 46 for receiving the vertical columnar stream of air 40. Orifice 46 is somewhat larger than ceiling air vent 34 and is circular in shape, although it is contemplated that various shapes and sizes can be used. Optimally, opening 46 is positioned about three feet or less from ceiling air vent 34, and is large enough so that air columnar stream 40 can expand somewhat as it flows downwardly. However, it is noted that particular ventilation system needs may vary depending upon local ventilation characteristics such as the cross flow of ambient room air. In locations where the room air is relatively stable, ceiling-to-cabinet distances larger than three feet are believed to be acceptable, however three feet or less is generally preferred.

Figure 3:
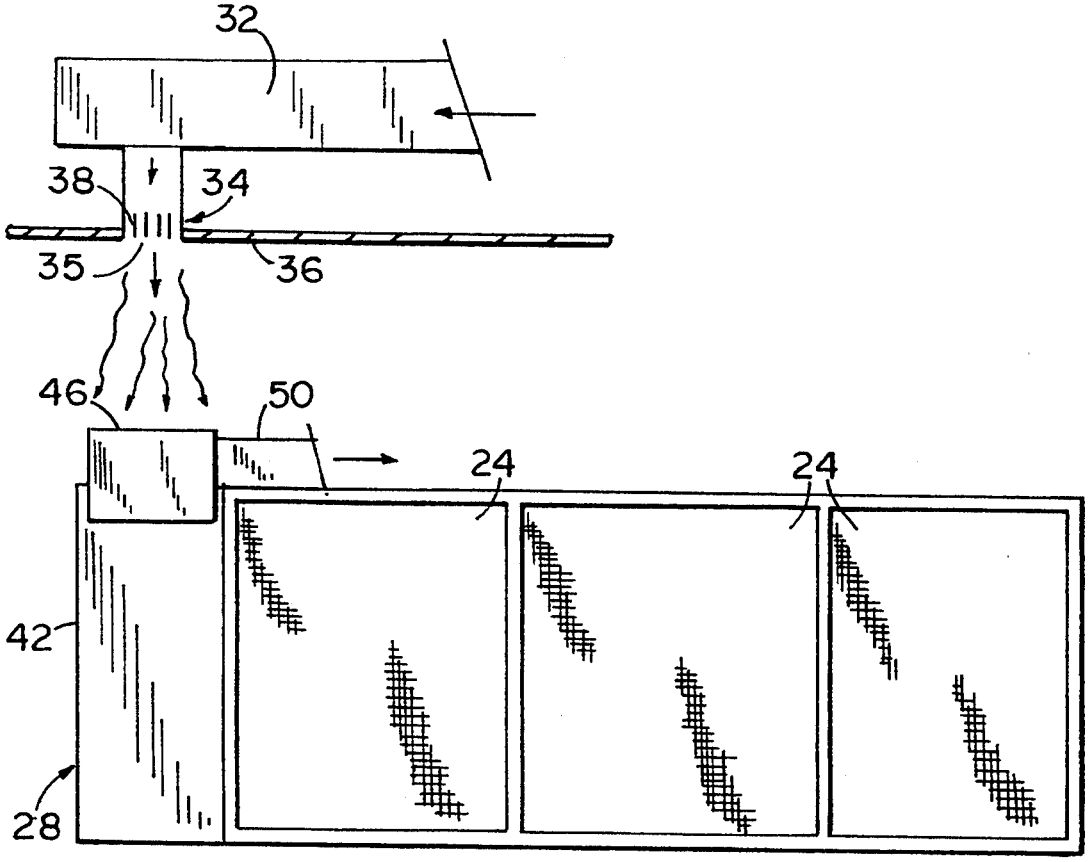
FIG. 3 is a schematic elevational view showing the air flow from an overhead duct to the ventilation system.
Figure 4A:
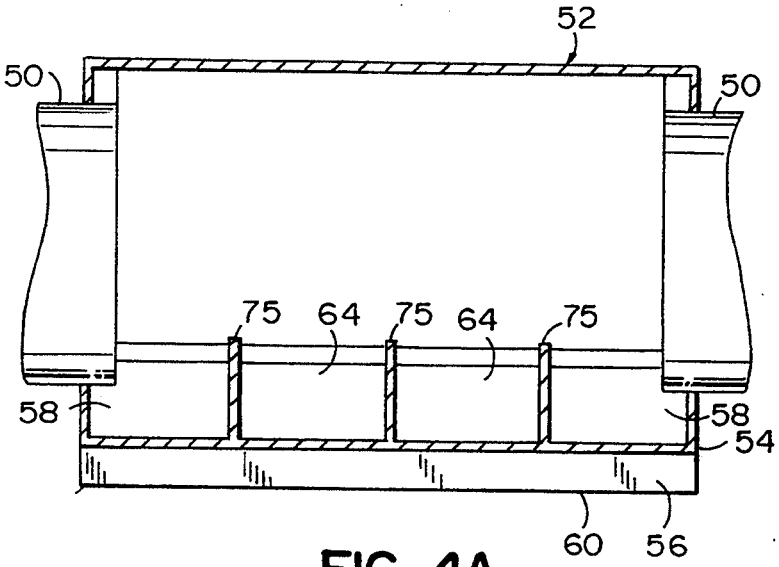
FIG. 4A is a cross-sectional view taken longitudinally through the connector shown in FIG. 4.

Notably, various items can be done to improve the vertical air flow of air columnar stream 40 into cabinet opening 46 where necessary. These include shaping the elongated fins 38 in ceiling orifice 35 to focus and direct air accurately toward opening 46, positioning the inlet orifice 46 of collector and distributor unit 28 close to the ceiling orifice 35, adjusting the overhead air volume flow rates, and increasing the "sucking" action or negative pressure generated at opening 46. Optimally collection and distributor unit 28 (FIG. 3) draws the columnar stream of conditioned air 40 into orifice 46 at a desired air flow rate by creating a negative pressure by use a fan (not shown) in unit 28. Air passing through unit 28 can be filtered, humidified, or otherwise conditioned as desired. Further, it is contemplated that in many installations, collector and distributor unit 28 will mix the collected air stream 40 with ambient room air before dispensing the mixture to the workstations.

Air ducts 26 (FIGS. 1 and 2) include tubes 50 of various lengths interconnected by tube connectors 52. The illustrated tubes 50 are circular in shape for minimum air flow resistance per cross-sectional area, however alternative shapes are contemplated. Also, tees and corners (not shown) for connecting tubes 50 are contemplated. Notably, air ducts 26 are adapted to receive air from different air supplies and/or collector-and-distributor units, and the claims are not intended to be limited to only the particular air supply and collector-and-distributor unit shown unless by the claim language they specify otherwise. For example a collector-and-distributor unit having air inlet ductwork or liquid coolant piped into the unit could also be used with the air ducts 26, although some aesthetics and/or flexibility of rearrangement, may be lost.

Figure 4:
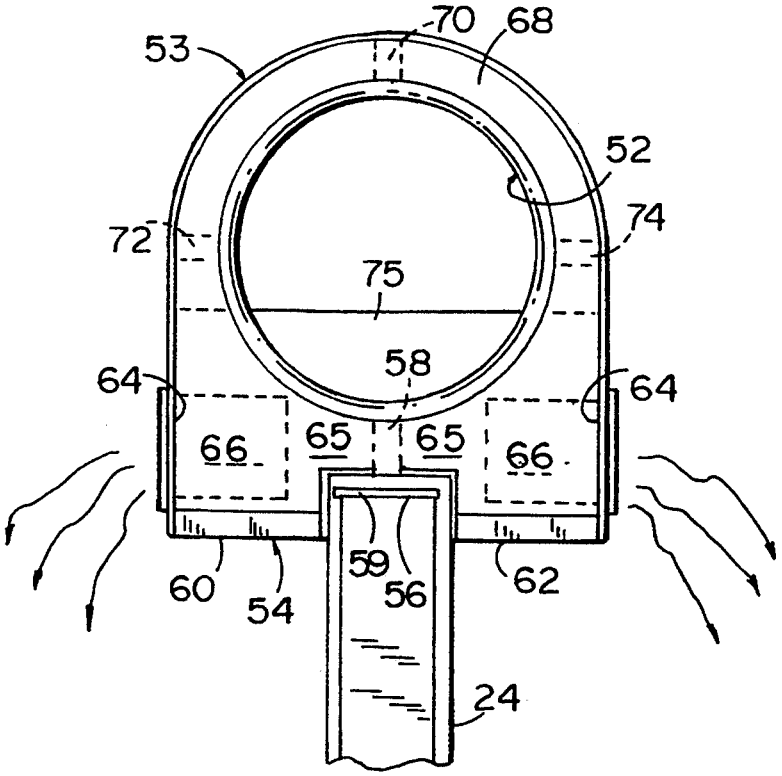
FIG. 4 is a cross sectional view taken along the plane IV—IV in FIG. 2.

Connectors 52 (FIG. 4) include a lower portion 54 with a U-shaped downwardly facing slot 56 therein. Slot 56 of lower portion 54 is adapted to stably receive the top edge 59 of a selected partition panel 24. The interconnection can be further stabilized by fasteners or adhesive if desired. Lower partition panel 54 includes a vertical rib or block 58 for supporting an end of a tube 50 placed in tube connectors 52 and for supporting deflectors 75 in an upright position, as discussed below. Two hollow legs 60 and 62 extend downwardly on lower portion 54 and straddle the top edge 59 of partition panel 24. Legs 60 and 62 each include an outwardly facing opening 64 adapted to receive an air diffuser 66.

Air diffusers 66 are comparable to those commonly used in automotive air conditioning ventilation systems in the vehicle instrument panels. Air diffuser 66 can be snapped into openings 64 for quick assembly, although alternative arrangements are contemplated. Air is communicated from tube 50 to air diffusers 66 across space 65 in connectors 52. It is further contemplated that air diffuser 66 may incorporate adjustable air deflectors or fins that can be vertically or horizontally adjusted to direct the dispensed air at different angles at individual workstations. (See FIG. 13.)

Air duct connector 52 further includes an upper portion 53 adapted to surround the end of a tube 50 placed therein. Connector 52 includes end panels 68 with apertures sized to mateably receive the ends of tubes 50, and further includes a top rib 70 and side ribs 72 and 74 that cooperate with bottom rib 58 to stably engage and center tube 50 in connector 52. A planar air deflector 75 is positionable in the lower half of the end of air duct 50 to direct air flowing through air duct 50 into the air diffusers 66 to create more even air flow through the diffuser. Rib 58 extends longitudinally in connector 52 into engagement with air deflector 75 to stabilize air deflectors 75 within connector 52.

Figure 5:
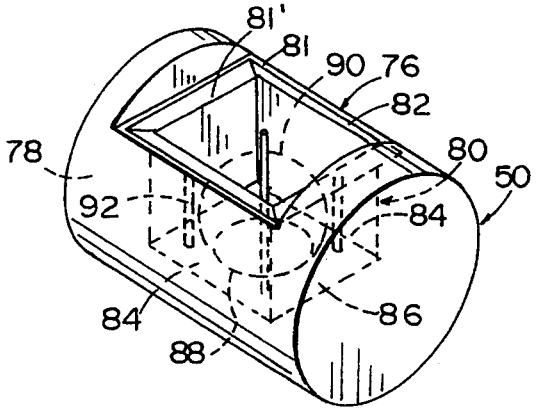
FIG. 5 is a perspective view of a pressure relief system installed in a section of an air duct.
Figure 6:
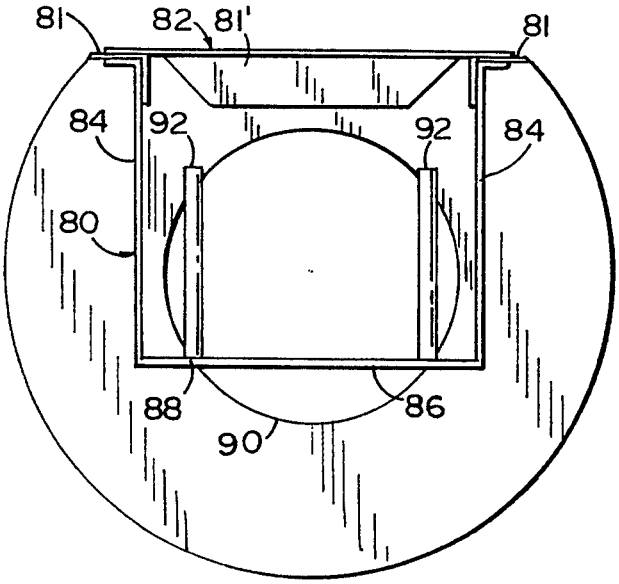
FIG. 6 is an end view of the pressure relief system shown in FIG. 5.

A pressure relief system 76 (FIGS. 5 and 6) is provided to prevent over-pressurization of air in duct 26. Pressure relief system 76 is adapted for placement in a remote location on a selected duct tube 50. For example, pressure relief system 76 could be located at an end of tube 50, where a tube end panel 78 sealingly closes off the end of tube 50. Pressure relief system 76 includes a closed box-shaped housing 80 adapted for mounting in an aperture 81' in the top of a selected tube 50. A flanged picture-frame-like bracket 82 (FIG. 6) sealingly engages the marginal edge 81 defining the aperture 81' in a sandwich-like arrangement with the top of housing 80. Housing 80 includes closed sides 84 and a bottom panel 86, with bottom panel 86 including a hole 88. A weighted sphere 90 having a diameter larger than hole 88 is placed in housing 80. Elongated pegs 92 protrude upwardly from bottom panel 86 around hole 88 to keep sphere 90 centrally located over hole 88 as sphere 90 is moved vertically by air pressure and air flow. The weight of sphere 90 is predetermined and calculated to hold sphere 90 matingly over hole 88 so that sphere 90 sealingly closes off hole 88 until a maximum predetermined pressure is sensed in duct 30. At that time, sphere 90 is lifted by air pressure so that air is allowed to flow around sphere 90 and flow out of hole 88. This prevents a particular workstation 22 from receiving an excessive amount of air if the air diffusers 66 at the other workstations are closed off.

Figure 7:
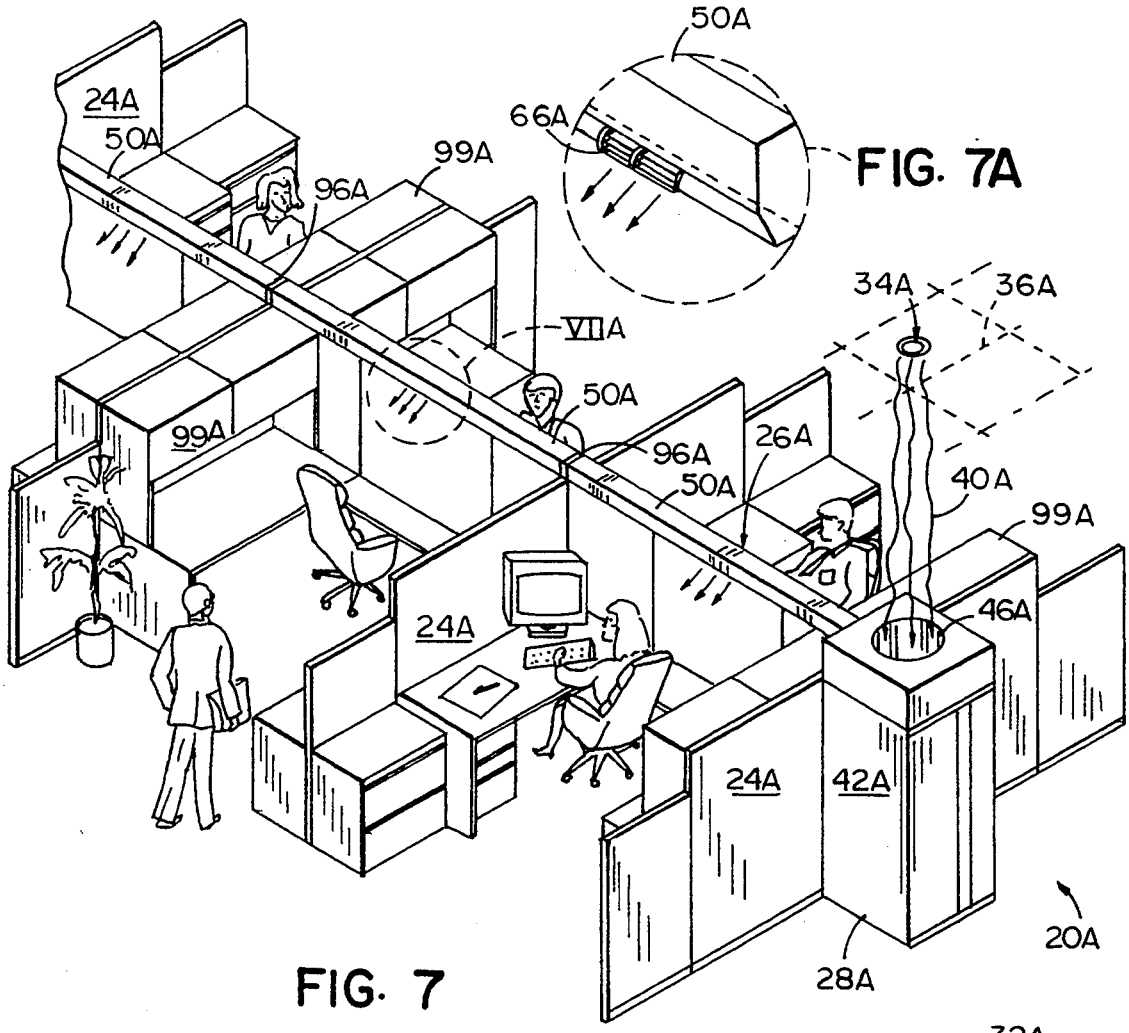
FIG. 7 is a perspective view of a modified workstation ventilation system embodying the present invention, the system being shown as installed in an office divided into workstations by partition panels.
Figure 8:
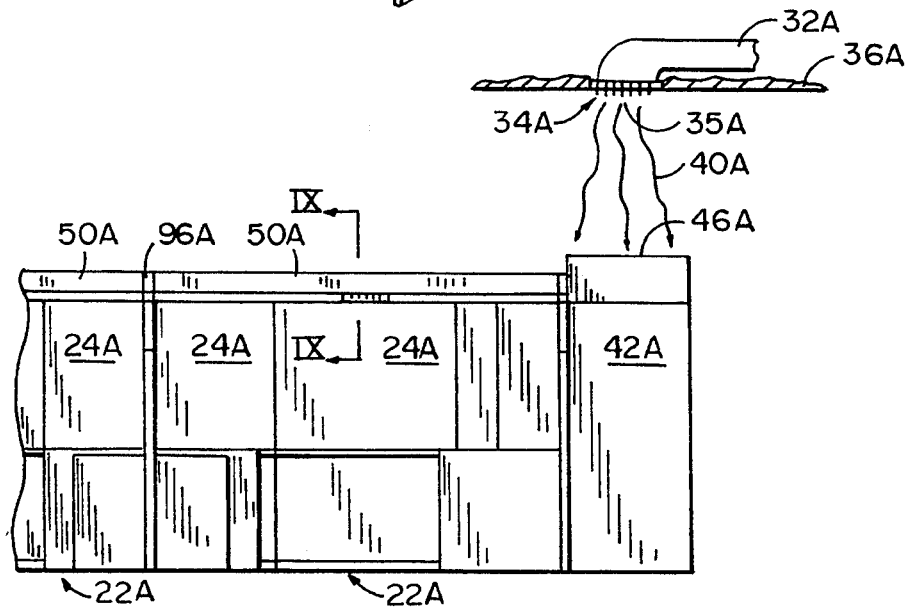
FIG. 8 is an elevational view of the modified ventilation system and office setting shown in FIG. 7.

A modified personal ventilation system 20A is shown in FIGS. 7 and 8. To reduce redundant discussion, comparable features of modified system 20A to system 20 are labelled by identical numbers but with the addition of the letter "A". Modified personal ventilation system 20A includes ducts 26A and collector and distributor unit 28A. Collector and distributor unit 28A is adapted to receive ventilation columnar stream of air 40A, with collector and distribution unit 28A dispensing air through ducts 26A.

Figure 9:
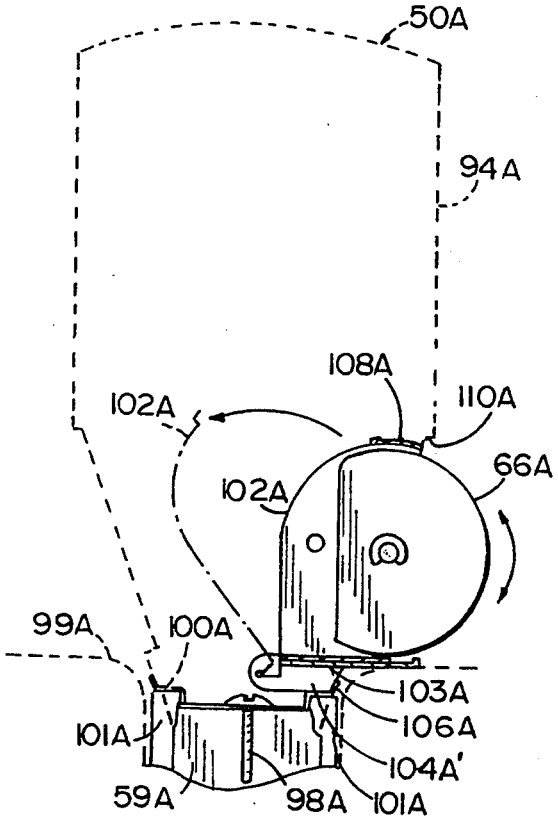
FIG. 9 is a cross sectional view taken along the plane IX—IX in FIG. 8.
Figure 11:
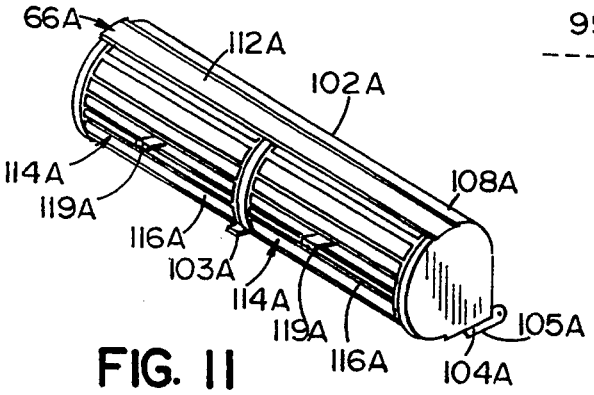
FIG. 11 is a perspective view of the air diffuser shown in FIG. 9.
Figure 12:
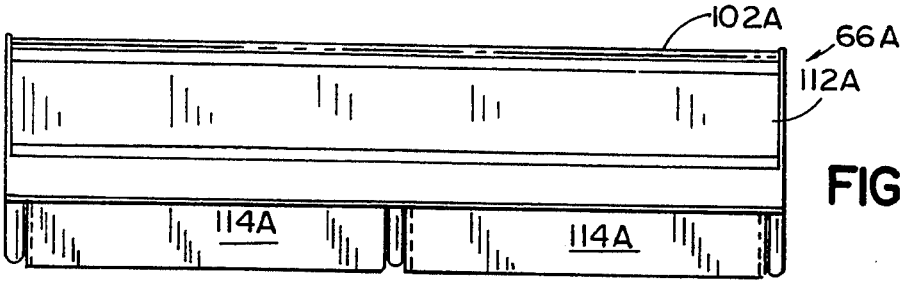
FIG. 12 is a top view of the air diffuser shown in FIG. 11.

Ducts 26A include multiple interconnected tubes 50A. Tubes 50A are connected by bands 96A that seal the tubes 50A together. Tubes 50A are attached to a panel top edge 59A (FIG. 9) such as by fasteners 98A or adhesive. It is contemplated that the lower portion of tubes 50A may or may not straddle panel top edge. 59A. It is also contemplated that tubes 50A can be of a preferred length, such as the length of a workstation, the length of a partition panel or other length as required by a particular design or shipping requirement.

Figure 10:
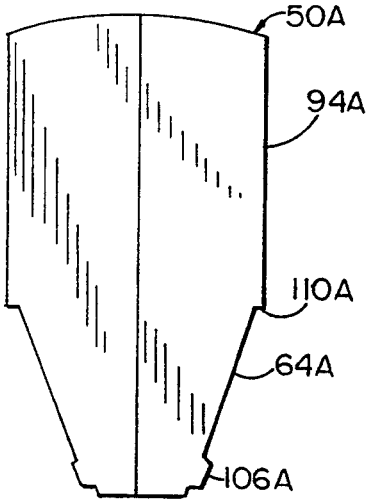
FIG. 10 is a cross section view of the air duct shown in FIG. 9 with the air diffuser removed for clarity.

In the illustrated form, the lower portion does not straddle or encroach on panel top edge 59A, thus allowing room for an overhead workstation bin 99A. As also shown, the lower portion of tubes 50A includes a ridge 100A that closely engages the top of panel front surface coverings 101A for stability and aesthetics. The lower portion of tubes 50A includes a laterally facing opening 64A (FIG. 10) for receiving air diffusers 66A. In the illustrated embodiment, on/off control of air flow is achieved by movement of a pivotable damper door 102A which is actuated by a damper door controller lever 103A.

Figure 13:
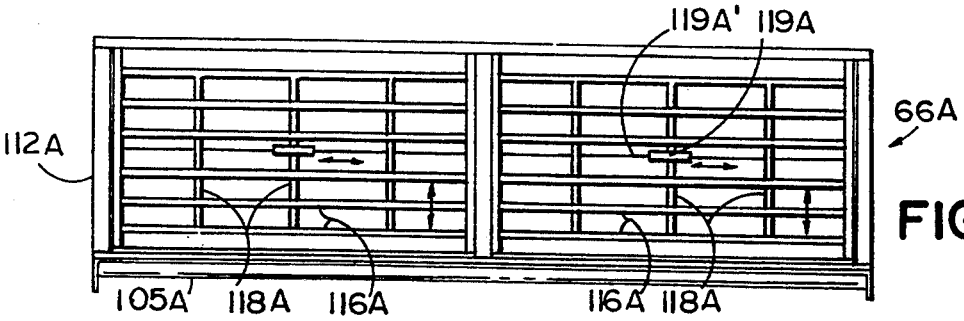
FIG. 13 is a front view of the air diffuser shown in FIG. 11.
Figure 14:
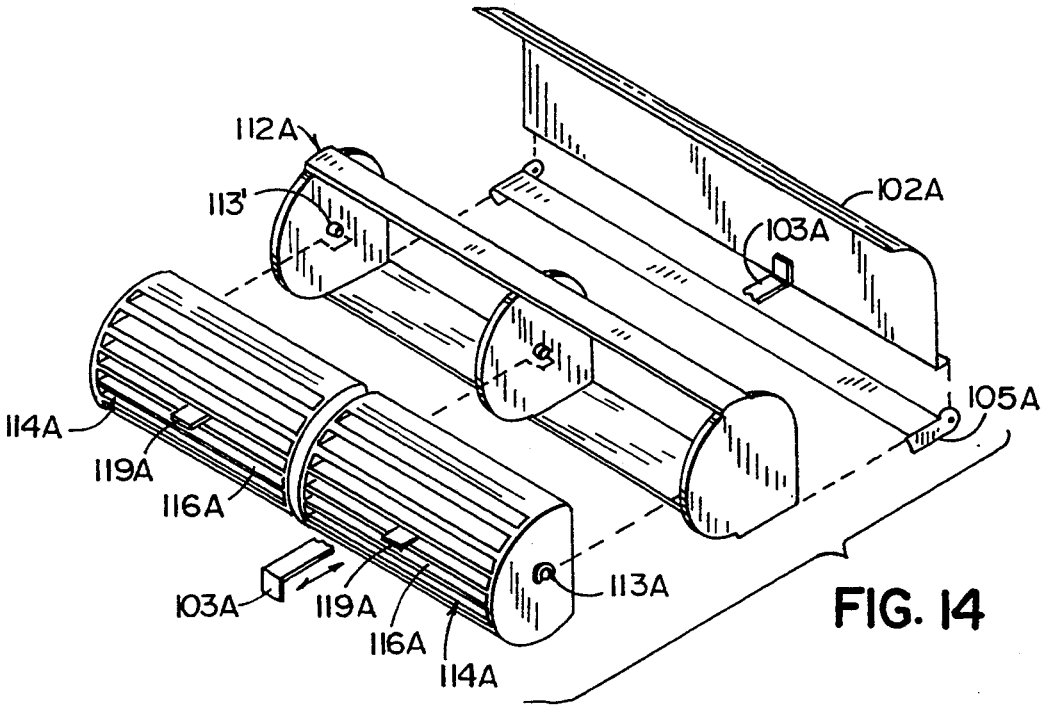
FIG. 14 is an exploded view of the air diffuser shown in FIG. 11.

Diffuser 66A includes a housing 112A (FIG. 14), a pair of rotatable bodies 114A each having horizontally oriented fins 116A, and adjustable secondary vertical fins 118A (FIG. 13). Damper door 102A is pivotally attached to a lower bracket 105A attached to the bottom of housfng 112A. Body 114A' is rotatable about pivots 113A on pivot receiving protrusions 113A in housing 112A so that the horizontally oriented fins 116A control the vertical air flow of conditioned air exiting through diffuser 66A. Vertically oriented fins 118A (FIG. 13) are interconnected by a link 119A' and rotatably mounted on rotatable body 114A so that vertical fins 118A can be adjusted angularly from side-to-side by moving tab 119A to control side-to-side flow of the conditioned air from diffuser 66A. Diffuser 66A (FIG. 9) is positioned in opening 64A with the lower edge 104A of diffuser 66A engaging lower lip 106A of the lower portion of tube 50A, and the upper edge 108A of diffuser 66A engaging an upper lip 110A of tube 50A. Diffuser 66A is then held in place such as by a bead of silicon adhesive, sealant or fasteners.

Figure 15:
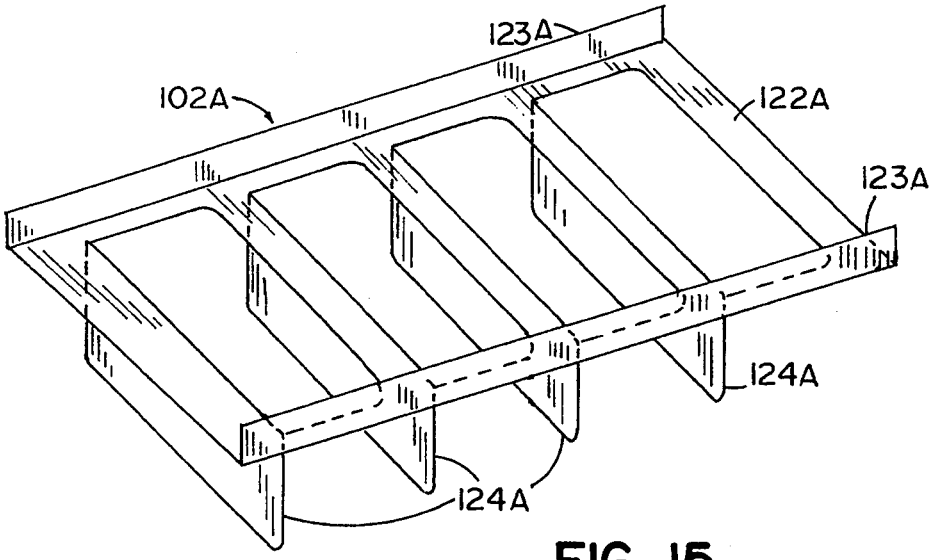
FIG. 15 is a multi-fin air deflector installable in the air ducts of the ventilation system to cause air to flow toward a particular air diffuser.
Figure 16:
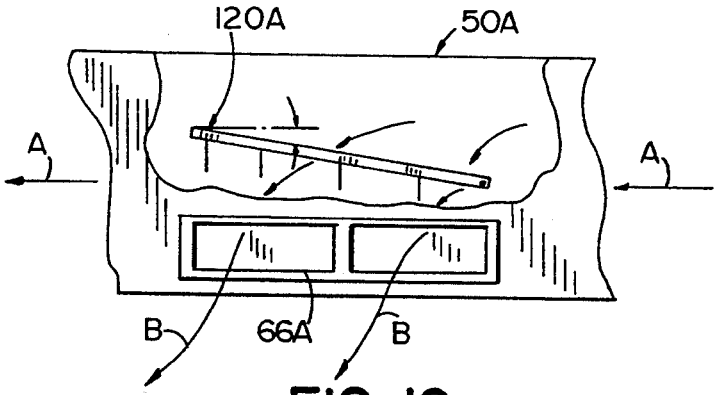
FIG. 16 is a schematic elevational view showing the multi-fin air deflector positioned in an air duct.

Ducts 50A include upper portion 94A for communicating the main body of air along ducts 50A from the collector and conditioner unit 28A to the individual workstations. A multi-fin air deflector 120A is positionable in the upper portion 94A (FIGS. 15 and 16) to direct air against air diffusers 66A to equalize the air flow across the diffusers. Multi-fin air deflector 120A includes an outer frame 122A adapted with an outer flange 123A adapted to engage the inner side wall surfaces of upper portion 94A of ducts 50A. An adhesive or other fastener means is used to secure the outer flanges 123A of frame 122A in duct 50A in a desired orientation. Fins 124A extend generally downwardly from frame 122A. As shown in FIG. 16, fins 124A create a deflector-like action which biases air flowing through ducts 26A (i.e. in direction A) toward air diffusers 66A for efficient distribution of the air across the diffuser (i.e. in direction B). Notably, the angle and position of air deflector 120A can be adjusted during installation as desired.

Thus, a workstation ventilation system is provided for offices that are divided into workstations by partition panels and the like. The ventilation system includes air ducts attached to the partition panels in the configuration of the partition panels, and further includes a collection and distribution unit for receiving air from an overhead ventilation system and for communicating the air through the air ducts to the individual workstations. In one form, the air ducts can be retrofittably attached to the partition panels to facilitate installation. Also, the air ducts include air diffusers at each workstation, which air diffusers include individually adjustable deflectors to direct the conditioned air from the air ducts into the workstation area as desired. A pressure relief system can also be incorporated into the air ducts to prevent over-pressurization of the air distribution system.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows:

1. In a modular furniture system of the type in which a plurality of modular furniture units are positioned in a preselected plan configuration to form multiple workstations, said modular furniture units including an upper portion, the improvement of a personal ventilation system therefor, comprising:

an air supply adapted to pressurize and flow ventilation air therethrough;

an air duct having a closed construction shaped to flow ventilation air therethrough, and arranged in a plan configuration similar to the preselected plan configuration of said modular furniture units, with said air duct extending along at least some of said modular furniture units to predetermined locations adjacent each of said workstations; said air duct being operably connected with said air supply to provide pressurized ventilation air at each of said workstations; said air duct being attached to said modular furniture units along said upper portion of said modular furniture units;

a plurality of air diffusers communicating with said air duct, and located at preselected positions adjacent each of said workstations; each of said air diffusers being adjustable to control the flow of ventilation air therethrough, whereby ventilation air from said air supply is supplied to each of said workstations through said air duct, and may be selectively flowed through said air diffusers to maximize personal comfort within each of said workstations.

2. In a modular furniture system of the type in which a plurality of modular furniture units are positioned in a preselected plan configuration to form multiple workstations, the improvement of a personal ventilation system therefor, comprising:

an air supply adapted to pressurized and flow ventilation air therethrough;

an air duct having a closed construction shaped to flow ventilation air therethrough, and arranged in a plan configuration similar to the preselected plan configuration of said modular furniture units, with said air duct extending along at least some of said modular furniture units to predetermined locations adjacent each of said workstations; said air duct being operably connected with said air supply to provide pressurized ventilation air at each of said workstations;

a plurality of air diffusers communicating with said air duct, and located at preselected positions adjacent each of said workstations; each of said air diffusers being adjustable to control the flow of ventilation air therethrough, whereby ventilation air from said air supply is supplied to each of said workstations through said air duct, and may be selectively flowed through said air diffusers to maximize personal comfort within each of said workstations;

said modular furniture units including upper edges arranged end-to-end in a mutually aligned relationship; and said air duct including a base portion thereof shaped to be abuttingly supported on the upper edges of said modular furniture units to provide ventilation air to each of said workstations without encroaching on the same.

3. A personal ventilation system as set forth in claim 2, wherein:

said air duct includes a plurality of substantially similar duct segments interconnected in an end-to-end fashion.

4. A personal ventilation system as set forth in claim wherein:

each of said duct segments has a length substantially commensurate with the width of an associated one of said modular furniture units.

5. A personal ventilation system as set forth in claim 4, wherein:

a damper associated with each of said air diffusers, and including an on/off control to selectively interrupt the flow of ventilation air therethrough.

6. A personal ventilation system as set forth in claim 5, wherein:

said air diffusers are each directionally adjustable to vary the direction of ventilation air flow therethrough.

7. A personal ventilation system as set forth in claim 6, including:

a plurality of air deflectors located in said air ducts proximate said air diffusers for forcing ventilation air toward said air diffusers.

8. A personal ventilation system as set forth in claim 7, including:

a pressure relief system located in said air duct, said relief system being adapted to release ventilation air from said air duct upon sensing excessive pressure in said air duct.

9. A personal ventilation system as set forth in claim 8 wherein said modular furniture units comprise portable partition panels.

10. A modular furniture system comprising:

a plurality of modular furniture units positioned in a preselected plan configuration to form multiple workstations, said modular furniture units including upper edges arranged end-to-end in a mutually aligned relationship;

an air supply adapted to pressurize and flow ventilation air therethrough;

an air duct having a closed construction shaped to flow ventilation air therethrough, and arranged in a plan configuration similar to the preselected plan configuration of said modular furniture units, with said air duct extending along at least some of said modular furniture units to predetermined locations adjacent each of said workstations, said air duct including a base portion thereof shaped to be abuttingly supported on the upper edges of said modular furniture units to avoid encroaching on said workstations, said air duct being operably connected with said air supply to provide pressurized ventilation air at each of said workstations; and a plurality of air diffusers communicating with said air duct, and located at preselected positions adjacent each of said workstations, each of said air diffusers being adjustable to control the flow of ventilation air therethrough, whereby ventilation air from said air supply is supplied to each of said workstations through said air duct, and may be selectively flowed through said air diffusers to maximize personal comfort within each of said workstations.

11. A modular furniture system as set forth in claim 10, wherein:

said air duct includes a plurality of substantially similar duct segments interconnected in an end-to-end fashion.

12. A modular furniture system as set forth in claim 11, wherein:

each of said duct segments has a length substantially commensurate with the width of an associated one of said furniture units.

13. A personal ventilation system for modular furniture arrangements of the type in which a plurality of modular furniture units are interconnected in a preselected plan configuration to form multiple workstations, said modular furniture units including an upper portion, said personal ventilation system comprising:

an air supply adapted to pressurize and flow ventilation air therethrough;

an air duct having a closed construction shaped to flow ventilation air therethrough, and arranged in a plan configuration similar to the preselected plan configuration of the modular furniture units, with said air duct extending along at least some of the modular furniture units to predetermined locations adjacent each of the workstations, said air duct being operably connected with said air supply to provide pressurized ventilation air at each of workstations; said air duct including connectors for mounting said air duct to said modular furniture units along said upper portion of said modular furniture units; and a plurality of air diffusers mounted in said air duct at preselected positions adjacent each of the workstations, each of said air diffusers being adjustable to control the flow of ventilation air therethrough, whereby ventilation air from said air supply is supplied to each of the workstations through said air duct, and may be selectively flowed through said air diffusers to maximize personal comfort within each of the workstations.

14. A personal ventilation system A personal ventilation system for modular furniture arrangements of the type in which a plurality of modular furniture units are interconnected in a preselected plan configuration to form multiple workstations, said personal ventilation system comprising:

an air supply adapted to pressurized and flow ventilation air therethrough;

an air duct having a closed construction shaped to flow ventilation air therethrough, and arranged in a plan configuration similar to the preselected plan configuration of the modular furniture units, with said air duct extending along at least some of the modular furniture units to predetermined locations adjacent each of the workstations, said air duct being operably connected with said air supply to provide pressurized ventilation air at each of workstations;

a plurality of air diffusers mounted in said air duct at preselected positions adjacent each of the workstations, each of said air diffusers being adjustable to control the flow of ventilation air therethrough, whereby ventilation air from said air supply is supplied to each of the workstations through said air duct, and may be selectively flowed through said air diffusers to maximize personal comfort within each of the workstations; and said air duct including a base portion thereof shaped to be abuttingly supported on upper edges of the modular furniture units to provide ventilation air to each of the workstations without encroaching on the same.

15. A personal ventilation system as set forth in claim 14, wherein:

said air duct includes a plurality of substantially similar duct segments interconnected in an end-to-end fashion.

16. A ventilation system for open office plans and the like of the type having a plurality of furniture units arranged in a predetermined furniture landscape within a building room to define multiple workstations therein, and with overhead ductwork in a ceiling of the building room through which ventilation air is distributed from a building source into the building room, said ventilation system comprising:

an outlet unit positioned in the ceiling of the building room, and communicating with the overhead ductwork, said outlet unit including an outlet orifice shaped to focus ventilation air passing therethrough into a generally vertically oriented, substantially columnar stream;

a collector and distributor unit associated with the furniture units, and positioned a spaced apart distance below the ceiling, said collector and distributor unit including:

an inlet orifice positioned generally directly below said outlet orifice, and shaped to collect and funnel ventilation air in the columnar stream;

means for distributing ventilation air flowing through said inlet orifice to the workstations; and means for flowing ventilation air through said collector and distributor unit, whereby ventilation air from the building source is fed from the ceiling of the building room to the workstations for local distribution, without any structural ductwork between the ceiling and the furniture units, so as to provide improved versatility in furniture unit placement, while avoiding impairing the appearance of the furniture landscape.

17. A ventilation system as set forth in claim 16, wherein:

said collector and distributor unit is housed in a free-standing cabinet positioned adjacent to the furniture units, and operably connected with the same.

18. A ventilation system as set forth in claim 17, wherein said means for distributing ventilation air to the workstations includes:

an air duct having a closed construction shaped to flow ventilation air therethrough, and arranged in a plan configuration similar to the plan shape of the predetermined furniture landscape, with said air duct extending along at least some of the furniture units to predetermined locations adjacent each of the workstations; and a plurality of air diffusers mounted in said air duct at preselected positions adjacent each of the workstations, each of said air diffusers being adjustable to control the flow of ventilation air therethrough, whereby ventilation air from said collector and distributor is supplied to each of the workstations through said air duct, and may be selectively flowed through said air diffusers to maximize personal comfort within each of the workstations.

19. A ventilation system as set forth in claim 18, wherein:

said air duct includes a base portion thereof shaped to be abuttingly supported on upper aligned edges of the furniture units to provide ventilation air to each of the workstations without encroaching on the same.

20. A personal ventilation system as set forth in claim 19, wherein:

said air duct includes a plurality of substantially similar duct segments interconnected in an end-to-end fashion.

21. A personal ventilation system as set forth in claim wherein:

each of said duct segments has a length substantially commensurate with the width of an associated one of the furniture units.

22. In an open office plan of the type having a plurality of furniture units arranged in a predetermined furniture landscape within a building room to define multiple workstations therein, and with overhead ductwork in a ceiling of the building room through which ventilation air is distributed from a building source into the building room, the improvement of a ventilation system therefor, comprising:

an outlet unit positioned in the ceiling of the building room, and communicating with the overhead ductwork, said outlet unit including an outlet orifice shaped to focus ventilation air passing therethrough into a generally vertically oriented, substantially columnar stream;

a collector and distributor unit associated with said furniture units, and positioned a spaced apart distance below the ceiling, said collector and distributor unit including:

an inlet orifice positioned generally directly below said outlet orifice, and shaped to collect and funnel ventilation air in the columnar stream;

means for distributing ventilation air flowing through said inlet orifice to the workstations; and means for flowing ventilation air through said collector and distributor unit, whereby ventilation air from the building source is fed from the ceiling of the building room to the workstations for local distribution, without any structural ductwork between the ceiling and said furniture units, so as to provide improved versatility in furniture unit placement, while avoiding impairing the appearance of the furniture landscape.

23. An air feed arrangement for ventilation systems in open office plans and the like of the type having a plurality of furniture units arranged in a predetermined furniture landscape within a building room to define multiple workstations therein, and with overhead ductwork in a ceiling of the building room through which ventilation air is distributed from a building source into the building room, said air feed comprising:

an outlet unit adapted to be positioned in the ceiling of the building room, and communicating with the overhead ductwork, said outlet unit including an outlet orifice shaped to focus ventilation air passing therethrough into a generally vertically oriented, substantially columnar stream;

a collector and distributor unit associated with the furniture units, and positioned a spaced apart distance below the ceiling, said collector and distributor unit including:

an inlet orifice positioned generally directly below said outlet orifice, and shaped to collect and funnel ventilation air in the columnar stream;

means for distributing ventilation air flowing through said inlet orifice to the workstations; and means for flowing ventilation air through said collector and distributor unit, whereby ventilation air from the building source is fed from the ceiling of the building room to the workstations for local distribution, without any structural ductwork between the ceiling and the furniture units, so as to provide improved versatility in furniture unit placement, while avoiding impairing the appearance of the furniture landscape.

24. A partition panel system, comprising:

a plurality of partition panels interconnected in a preselected plan configuration to form multiple workstations, said partition panels including upper panel edges arranged end-to-end in a mutually aligned relationship;

an air supply adapted to pressurize and flow ventilation air therethrough;

an air duct having a closed construction shaped to flow ventilation air therethrough, and arranged in a plan configuration similar to the preselected plan configuration of said partition panels, with said air duct extending along at least some of said partition panels to predetermined locations adjacent each of said workstations, said air duct including a base portion thereof shaped to be abuttingly supported on the upper panel edges of said partition panels to avoid encroaching on said workstations, said air duct being operably connected with said air supply to provide pressurized ventilation air at each of said workstations; and a plurality of air diffusers communicating with said air duct, and located at preselected positions adjacent each of said workstations, each of said air diffusers being adjustable to control the flow of ventilation air therethrough, whereby ventilation air from said air supply is supplied to each of said workstations through said air duct, and may be selectively flowed through said air diffusers to maximize personal comfort within each of said workstations.

* * * * *

UNITED STATES PATENT AND TRADEMARK OFFICE

CERTIFICATE OF CORRECTION

PATENT NO. : 5,358,444

DATED : October 25, 1994

INVENTOR(S) : Randall S. Helm et al.

It is certified that error appears in the above-indentified patent and that said Letters Patent is hereby corrected as shown below:

Column 6, line 22:
"housfng" should be --housing--.

Column 6, line 22:
"Body 114A'" should be --Body 114A--.

Column 6, line 23:
"113A" (second occurrence) should be --113A'--.

Column 8, claim 4, line 18:
After "claim" insert --3--.

Signed and Sealed this

Fifth Day of September, 1995

*Attest:*

*Attesting Officer*

BRUCE LEHMAN

*Commissioner of Patents and Trademarks*